US006691328B2

(12) United States Patent
Delfino

(10) Patent No.: US 6,691,328 B2
(45) Date of Patent: Feb. 17, 2004

(54) FLUID DISPENSING BOTTLE HAVING A REFILLABLE RESERVOIR AND A METERING SECTION

(76) Inventor: Nicholas A. Delfino, 2601 Nassau Bend, Suite 2C, Coconut Creek, FL (US) 33066

( * ) Notice: Subject to any disclaimer, the term of this patent is extended or adjusted under 35 U.S.C. 154(b) by 0 days.

(21) Appl. No.: 10/195,219

(22) Filed: Jul. 15, 2002

(65) Prior Publication Data

US 2003/0009818 A1 Jan. 16, 2003

Related U.S. Application Data

(60) Provisional application No. 60/305,477, filed on Jul. 13, 2001, and provisional application No. 60/337,972, filed on Nov. 8, 2001.

(51) Int. Cl.[7] ..... E03D 9/03

(52) U.S. Cl. ..... 4/227.1; 4/222; 4/223; 4/227.2; 4/231; 222/56; 222/57; 222/64

(58) Field of Search ..... 4/222, 223, 227.1, 4/227.2, 231; 222/56, 57, 58, 64, 67

(56) References Cited

U.S. PATENT DOCUMENTS 3,698,021 A 10/1972 Mack et al.
3,766,370 A 10/1973 Finneran
3,787,904 A * 1/1974 Lerner ..... 4/227.5
3,841,524 A 10/1974 Easter
3,908,209 A 9/1975 Fillmore
3,965,497 A 6/1976 Corsette
4,066,187 A 1/1978 Nieman et al.
4,285,074 A * 8/1981 Leinberry ..... 4/227.3
4,294,369 A 10/1981 Racine
4,346,483 A 8/1982 Rosen et al.
4,660,231 A 4/1987 McElfresh et al.
4,696,414 A * 9/1987 Huat ..... 222/67
4,915,260 A * 4/1990 Jones ..... 4/227.2
4,916,760 A 4/1990 Shahar

* cited by examiner

*Primary Examiner*—Gregory Huson
*Assistant Examiner*—Azy Kokabi
(74) *Attorney, Agent, or Firm*—Ronald V. Davidge

(57) ABSTRACT

A bottle used to dispense a fluid for cleaning a toilet bowl is configured to provide for refilling the bottle. Such a bottle includes a reservoir, a metering portion, and a cover, which is removable to expose an opening within the reservoir for refilling. The cover may include the metering portion, or it may be formed as a cap at an end of the reservoir opposite the metering portion.

8 Claims, 3 Drawing Sheets

FLUID DISPENSING BOTTLE HAVING A REFILLABLE RESERVOIR AND A METERING SECTION

This application claims benefit of U.S. Provisional Application No. 60/305,477, filed Jul. 13, 2001, and additionally of U.S. Provisional Application No. 60/337,972, filed Nov. 8, 2001.

BACKGROUND OF THE INVENTION

1. Field of the Invention

This invention relates to a refillable fluid dispensing bottle having a metering portion controlling a rate at which the fluid is dispensed, and, more particularly, to such a bottle filled with a fluid assisting in the cleaning of a toilet bowl.

2. Summary of the Background Art

A number of types of bottles are used to dispense fluids for cleaning toilet bowls. Such fluids may also contain dyes and fragrant substances. Certain of such bottles are particularly constructed to spray fluids directly into place within a toilet bowl, while other examples of such bottles are constructed to hang within a toilet tank, and to dispense a cleaning fluid that is carried to the toilet bowl when the toilet is flushed.

A number of patents describe fluid dispensing bottles with particular provisions allowing the bottle to be hung in an inverted orientation on the side of a toilet tank to extend downward within the tank so that a fluid dispensing end of the bottle extends into a region that is normally full of water from the tank, but that is drained of water from the tank, and subsequently refilled, whenever the toilet is flushed. The dispensing end of such a bottle includes a float that falls as water is drained from the area of the fluid dispensing end and that rises as water is subsequently restored around the fluid dispensing end. As the float moves in this way, a predetermined volume of fluid stored in a reservoir portion of the fluid dispensing bottle is dispensed. The normal operation of the toilet causes liquid within the tank, including fluid dispensed from the fluid dispensing bottle, to be carried to the toilet bowl. The fluid dispensed fluid dispensing bottle includes, for example, chemicals that help keep the toilet bowl clean, a dye to color the toilet bowl water, and chemicals providing a pleasant fragrance.

Descriptions of such fluid dispensing bottles are found, for example, in U.S. Pat. Nos. 3,398,021, 3,841,524, 3,908,209, 4,066,187, 4,294,369, 4,294,369, and 4,660,231. In each of these patents, the float is held within a metering assembly that is pressed into place in the mouth of the fluid dispensing bottle, apparently before a reservoir portion of the bottle is filled with fluid, with no provision being made for removing the metering assembly from the reservoir portion of the bottle. Therefore, what is needed is a method for gaining access to the reservoir portion of the bottle so that it can be refilled.

A method for refilling such a fluid dispensing bottle is particularly important, since the bottle cannot be made arbitrarily large to hold an economical quantity of fluid. It must be small enough to fit easily along an edge of a variety of toilet tanks, and it must be short enough to be completely uncovered with water when the toilet is flushed. Furthermore, if an ability to refill the bottle is not provided, a new metering mechanism, as well as a new bottle, must be provided each time the quantity of fluid within the bottle is used. Furthermore, since a fluid dispensing bottle of this kind is used within the water of a toilet tank, what is particularly needed is a way to refill the fluid dispensing bottle without removing it from the water.

U.S. Pat. Nos. 3,787,904, 3,965,497 and 4,916,760 describe fluid dispensing bottles that are used in a similar way, being supported in an inverted orientation to extend downward into the water of a toilet tank. However, these bottles do not include a float within a metering mechanism, and instead use apertures to establish a rate at which fluid is dispensed. U.S. Pat. No. 3,965,497 describes a gap forming an annular path for fluid flow through an aperture as being adjusted by rotating a threaded cap. U.S. Pat. No. 4,916,760 describes a system of apertures and spaces without moving parts that causes fluid to be dispensed due to changes in pressure as the water level in the toilet tank falls and rises with flushing. While these fluid dispensing bottles include screw caps, the openings that may be exposed by removing the caps are to small to be conveniently used for refilling. Still what is needed is a method providing access to the reservoir portions of the bottles for refilling, particularly if such a method provides for refilling the bottles without removing them from toilet tanks.

Yet other bottles are constructed to assist in manually cleaning the toilet bowl by spraying a cleaning fluid through metering portions that are inclined to facilitate directing a spray to surfaces within the toilet bowl. Such bottles include apertures through which the fluid is sprayed as the flexible sides of the bottle are squeezed. The size of such a bottle is limited by a need to be able to maneuver it within the toilet bowl. What is needed is a convenient method for refilling such a bottle from a larger supply bottle.

SUMMARY OF THE INVENTION

According to a first aspect of the invention, a fluid dispensing bottle for cleaning a toilet is provided. The bottle includes a reservoir, a metering portion, and a covering portion. The reservoir extends within the bottle holding a fluid cleaning surfaces within the toilet, wherein the reservoir includes an external opening. The metering portion extends from the reservoir, with the fluid being dispensed through an external opening within the metering portion, and with the metering portion controlling a rate at which the fluid is dispensed. The covering portion is attached to close the external opening of the reservoir and is removable to outwardly expose the external opening for refilling the reservoir.

The covering portion may include the metering portion, with the covering portion being attached to close the external opening of the reservoir by screw threads extending around the external opening of the reservoir. The covering portion may additionally include a cap attached to close the external opening of the metering portion by screw threads extending around the external opening of the reservoir, with the cap being removable to outwardly expose the external opening of the metering portion, and with the cap being attachable to close the external opening of the reservoir by the screw threads extending around the external opening of the reservoir.

In certain embodiments, the bottle includes a hook for hanging the bottle in an inverted orientation, and the metering portion includes a floating member moving with a level of water extending around the bottle in the inverted orientation to dispense a predetermined quantity of fluid through the external opening in the metering portion. The covering portion either includes the metering portion, or, alternately, the covering portion is formed as a cap extending at an end of the reservoir within the bottle opposite the metering portion, so that the bottle can be refilled by removing the cap without removing the bottle from its inverted position within the toilet tank, and by subsequently replacing the cap.

In another embodiment, the metering portion includes an aperture limiting a flow of the fluid through the metering portion, with the reservoir including a flexible side, and with the fluid flowing through the aperture as the flexible side is depressed.

DETAILED DESCRIPTION OF THE INVENTION

Figure 1:
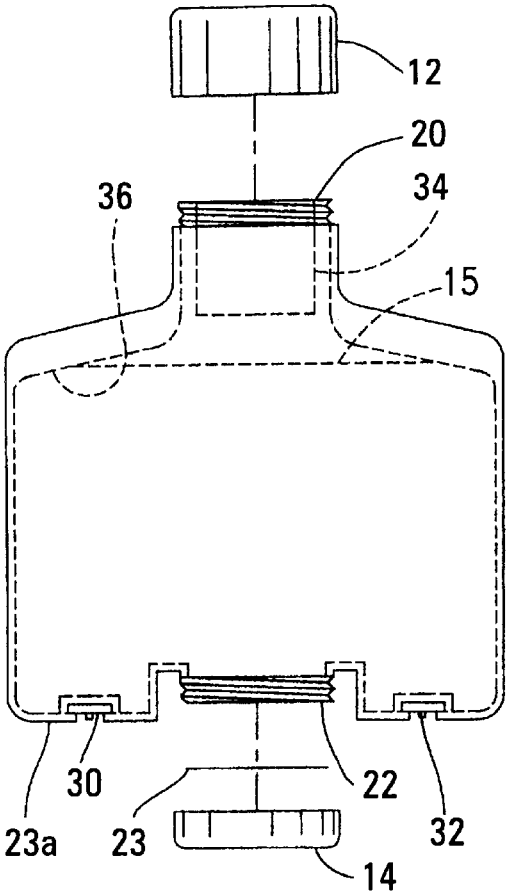
FIG. 1 is a front elevation of a bottle made in accordance with a first embodiment of the invention, in an exploded relationship with a dispensing cap and a refilling cap.
Figure 2:
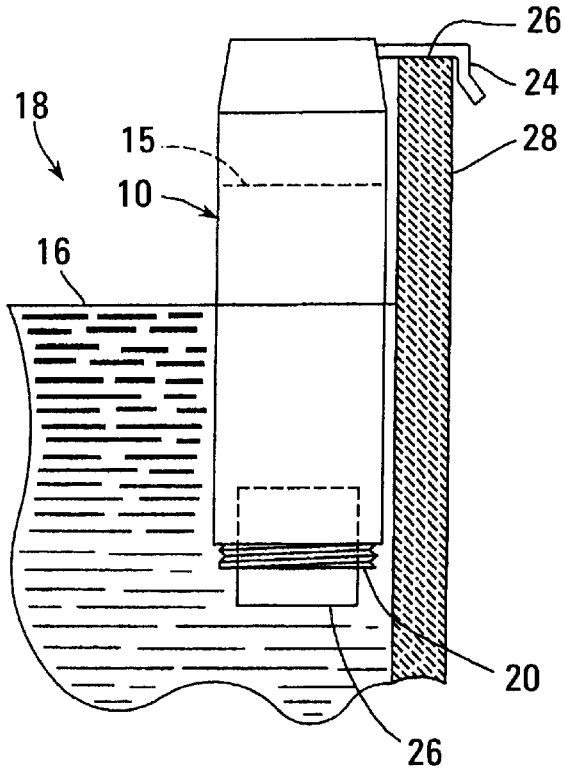
FIG. 2 is a side elevation of the bottle of FIG. 1, shown in an inverted orientation to dispense a fluid into the water within a toilet tank.

A first embodiment of the invention will now be described in reference to FIGS. 1 and 2, of which FIG. 1 is a front elevation of a bottle 10 made in accordance with the first embodiment, in an exploded relationship with a dispensing cap 12 and a refilling cap 14, and of which FIG. 2 is a side elevation of the bottle 1, in an inverted orientation to dispense a fluid 15 within a toilet tank 18.

The bottle 10 is originally provided in a condition filled with the fluid 15, having a dispensing cap 12 screwed in place on a threaded dispensing opening 20 and a refilling cap 14 screwed in place on a threaded refilling opening 22. Preferably, a seal 23 is adhesively attached to cover the refilling opening 22 to prevent leakage during storage and shipment. Preferably, the threaded refilling opening 22 is recessed sufficiently to allow the bottle 10 to rest on its lower surface 23*a* with the refilling cap 14 screwed in place.

The bottle is placed into usage by removing the dispensing cap 12, by extending a pair of sliding hooks 24, and by placing the bottle 10 in the inverted orientation of FIG. 2, with the hooks 24 extending over an edge 26 of the toilet tank wall 28. Each of the hooks 24 is slidably mounted within a slot 30 in the bottle 10. A pair of pin structures 32 extends outward from the bottle 10 through slots (not shown) within the hooks 24, with the ends of these slots within the hooks 24 limiting the sliding motion of the hooks 24. These ends may be enlarged to also provide a detent function, holding the hooks 24 in the extended condition shown in FIG. 2.

A floating member 34 within the dispensing opening 20 moves upward and downward with the water level as the toilet, of which tank 18 is a part, is flushed, causing the floating member 34 to dispense a small amount of the fluid 15 into the water 16, with the bottle 10 being held in a position within the toilet tank 18 in which the floating member 34 is covered with water except when the toilet is flushed, and in which water is drained from the floating member 34 during the flushing process. The operation of the floating member 34 is, for example, as described in one of the U.S. Pat. Nos. 3,398,021, 3,841,524, 3,908,209, 4,066,187, 4,294,369, 4,294,369, and 4,660,231, the disclosure of each of which is incorporated herein by reference. The fluid 15 is preferably of a type helping water and surfaces touched by the water within the toilet to remain clean. The fluid 15 may also change the color and odor of the water and provide a desirable fragrance.

The presence of the floating member 34 within the dispensing opening 20 prevents refilling the bottle 10 through this opening 20. To refill the bottle 10, the dispensing cap 14 is removed, as is the seal 23, and the refill liquid is poured in from above, with the bottle remaining inverted, as shown in FIG. 2. Preferably, this refilling operation is carried out with the bottle remaining in situ, within the toilet tank. Alternately, the bottle may be refilled in this manner with a concentrated liquid or powder, and with water for dilution.

It is desirable that the bottle 10 remains in the position shown in FIG. 2 without floating as it is emptied of fluid. To this end, wall sections 36 may be thickened to increase their contribution to the weight of the bottle. Stability is enhanced if these thickened wall sections 36 are near the bottom of the bottle in its inverted orientation of FIG. 2.

In an alternate version of this embodiment of the invention, the floating member 34 is replaced by a metering mechanism not including moving parts, with fluid being dispensed as a result of changes in pressure among chambers during the toilet flushing process, as described in U.S. Pat. No. 4,916,760, the disclosure of which is incorporated herein by reference.

Figure 3:
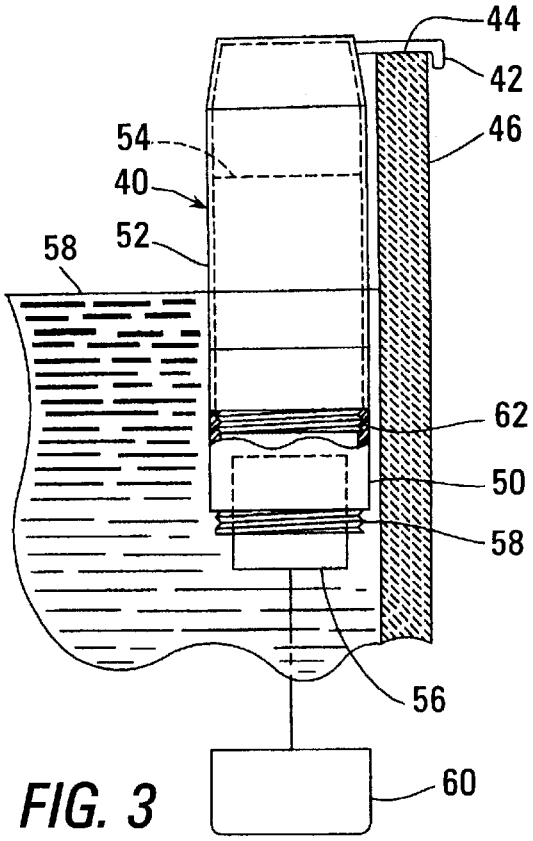
FIG. 3 is a partly sectional side elevation of a bottle made in accordance with a second embodiment of the invention, shown in an inverted orientation to dispense a fluid into the water within a toilet tank.

FIG. 3 is a partially sectional side elevation of a bottle 40 made according to a second embodiment of the present invention, shown in a fluid dispensing orientation. The bottle 40 includes a sliding hook 42, which is pulled outward to extend over an edge 44 of a toilet tank 46, so that the bottle 40 is held in place in an inverted position as shown, with the water 48 within the tank 46 submerging at least part of a metering portion 50 of the bottle 10. A reservoir portion 52 of the bottle 10 is at least partly full of a liquid 24. The metering portion 20 includes a float 56, which is arranged to hold the liquid 24 in place when the toilet tank 16 is full and to dispense a portion of the liquid 24 when the level of the toilet tank is lowered by flushing. The float 56 may be of a conventional type, presently used in a commercially available product, which floats upward with the water level of the tank 16 to seal an opening (not shown) preventing a flow of the liquid 54. This type of float then moves downward with the lowering of the water level of the tank 16 to allow a flow of the liquid 24. Alternate versions of this embodiment of the invention may include floating members as described in U.S. Pat. Nos. 3,398,021, 3,841,524, 3,908,209, 4,066,187, 4,294,369, 4,294,369, and 4,660,231.

The metering portion 20 also includes external threads 28 by which a cap 30, shown in an exploded relationship with the bottle 10, may be attached to prevent a flow of the liquid 24 from the bottle 10 when it is stored and transported.

The metering portion 20 is attached to the reservoir portion 22 by means of a threaded connection 32 including mating internal and external threads, allowing the removal of the metering portion 10 from the reservoir portion 22, and also allowing the subsequent reattachment of the portions 20, 22. In this way, the reservoir portion 22 can be easily refilled from a larger container of liquid. This provision for refilling is particularly desirable, since the bottle 10 must be small enough to fit properly within the toilet tank 16, and since the use of a significantly larger bottle for refilling provides substantial savings, both in manufacturing and associated costs, and in reducing the material required to make bottles holding the liquid.

Figure 4:
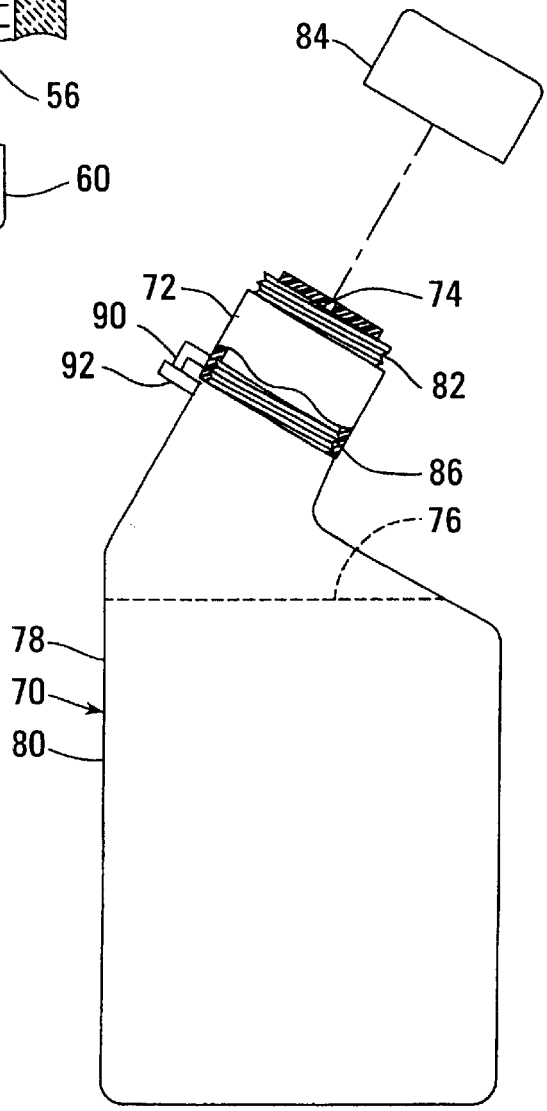
FIG. 4 is a partly sectional side elevation of a bottle made in accordance with a third embodiment of the invention, shown in an exploded relationship with a dispensing cap.

FIG. 4 is a partially sectional front elevation of a bottle 70 made according to a third embodiment of the present invention. The bottle 70 includes a metering portion 72, having an orifice 74, through which a liquid 76 is expelled when a reservoir portion 78 of the bottle 70, having flexible walls 80, is squeezed. The orifice 74 controls the rate at which liquid is expelled and provides the liquid being expelled with an exit velocity directing the liquid to an adjacent surface on which it is to be applied. The metering portion 72 includes external threads 82 for holding a cap 84, shown in an exploded relationship with the bottle 40 in place, preventing leakage of liquid 76 from the bottle 70 when it is stored or transported.

As in the second embodiment, described above in reference to FIG. 3, the metering portion 72 is attached to the reservoir portion 78 by means of a threaded connection 86 including mating internal and external threads, allowing the removal of the metering portion 72 from the reservoir portion 78, and also allowing the subsequent reattachment of the portions 72, 78. In this way, the reservoir portion 72 can be easily refilled from a larger container of liquid. This provision for refilling is particularly desirable, since the bottle 70 must be small enough to be moved about within the confined space of a toilet bowl for applying a cleaning fluid, and since the use of a significantly larger bottle for refilling provides substantial savings, both in manufacturing and associated costs, and in reducing the material required to make bottles holding the liquid.

The threaded connection for the cap 84 and the threaded connection 56 between the metering portion 72 and the reservoir portion 78 may be provided with child resistant safety features. For example, the upper portion 88 of the threaded connection 86 may be provided with a downward extending tab 90, which is stopped against a tab 92, extending outward from the lower portion 94 of the threaded connection 86, so that the metering portion 72 cannot be unscrewed from the reservoir portion 78. This safety feature may be released by pressing the tab 92 downward.

Both the threaded connection 62 of the second embodiment and the threaded connection 86 of the third embodiment may be provided with non-standard threads, so that the metering portions 50, 72 cannot be placed on other types of bottles. Also, the threaded connections 58, 82 holding the caps 60, 84 in place may be similar to the threaded connections 62, 86 holding the metering portions 50, 72 in place so on the reservoir portions 52, 78, so that the caps 60, 84 can be used to seal the reservoir portions 52, 78 when the metering portions 50, 72 are removed.

Figure 5:
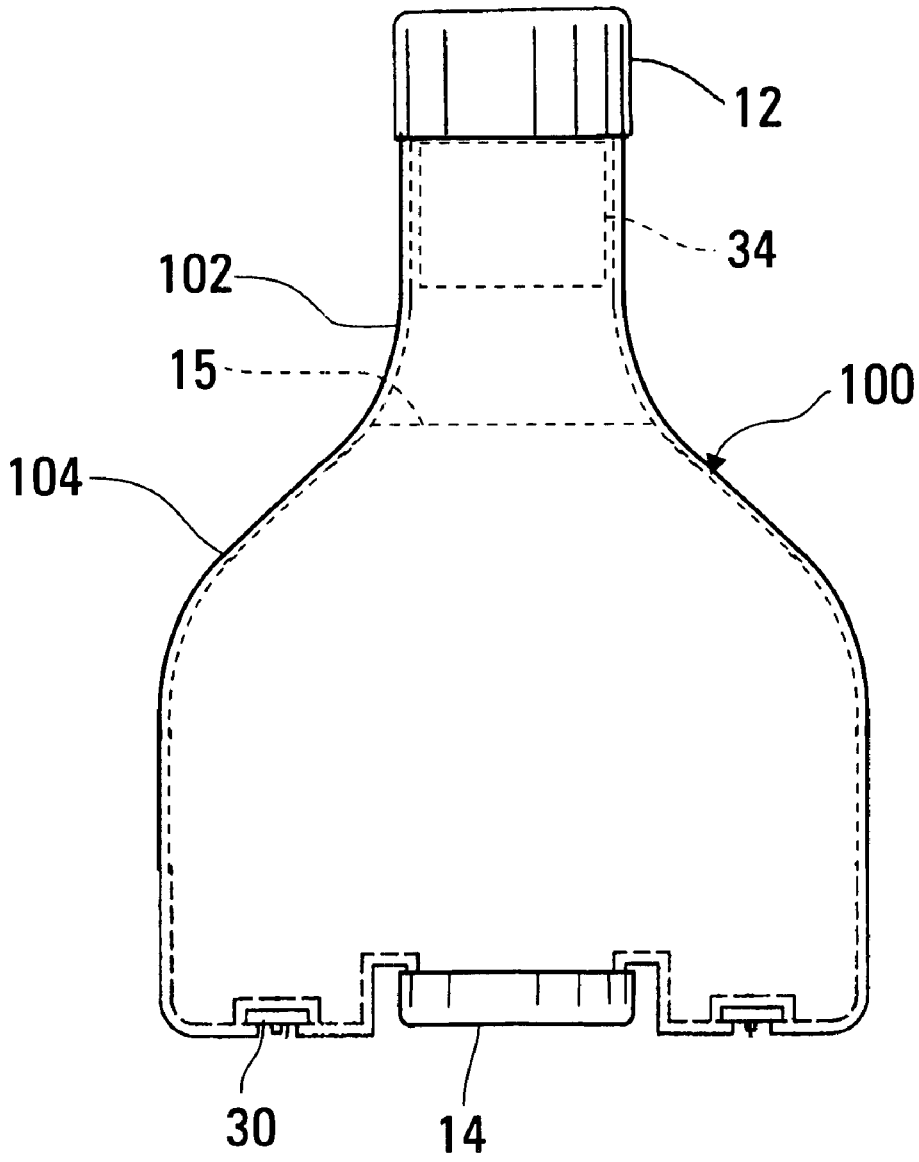
FIG. 5 is a front elevation of a bottle made in accordance with a fourth embodiment of the invention.

FIG. 5 is a front elevation of a bottle 100 made in accordance with a fourth embodiment of the invention. This bottle 100 is similar to the bottle 10, described above in reference to FIGS. 1 and 2, except that the neck portion 102 of the bottle 100 is substantially elongated. With similar components being accorded like reference numbers, the bottle 100 includes a reservoir 104, a floating member 34, a dispensing cap 12, a pair of sliding hooks 32 for attachment of the bottle 100 to extend in an inverted orientation within a toilet tank in the manner of FIG. 2, and a refilling cap 14, which is removed to refill the bottle 100 in this orientation without requiring its removal from the toilet tank.

The elongated neck 102 provides stability for the bottle 100 in its inverted orientation within the toilet tank by lowering the center of gravity of the bottle 100 relative to its center of buoyancy in this inverted orientation. Since the neck portion 102 is the narrowest part of the reservoir 104, the neck portion provides a greater relative increase in the weight of the empty bottle 100 than in its volume. Also, as the fluid 15 is exhausted from the bottle 100 as it is held inverted within the toilet tank, the remaining portion of the fluid 15 stays within the elongated neck portion 102, providing stability without a need to provide thickened wall sections 36, as described above in reference to FIG. 1.

While the invention has been described in preferred embodiments and versions with some degree of particularity, it is understood that this description has been given only by way of example, and that numerous changes can be made without departing from the spirit and scope of the invention.

What is claimed is:

1. A fluid dispensing bottle for cleaning a toilet, comprising:

a reservoir extending within said bottle holding a fluid cleaning surfaces within said toilet, wherein said reservoir includes a reservoir opening:

a metering portion, extending from said reservoir, wherein said fluid is dispensed through an external opening within said metering portion, and wherein said metering portion controls a rate at which said fluid is dispensed; and a covering portion attached to close said external opening of said reservoir, wherein said covering portion is removable to outwardly expose said external opening for refilling said reservoir, wherein said covering portion includes said metering portion.

2. The fluid dispensing bottle of claim 1, wherein said covering portion is attached to close said external opening of said reservoir by screw threads extending around said external opening of said reservoir.

3. The fluid dispensing bottle of claim 2, wherein said covering portion additionally includes a cap attached to close said external opening of said metering portion by screw threads extending around said external opening of said reservoir, said cap is removable to outwardly expose said external opening of said metering portion, and said cap is attachable to close said external opening of said reservoir by said screw threads extending around said external opening of said reservoir.

4. The fluid dispensing bottle of claim 1, wherein said bottle includes a hook for hanging said bottle in an inverted orientation, said metering portion includes a floating member moving with a level of water extending around said bottle in said inverted orientation to dispense a predetermined quantity of said fluid through said external opening in said metering portion.

5. The fluid dispensing bottle of claim 1, wherein said metering portion includes an aperture limiting a flow of said fluid through said metering portion, said reservoir includes a flexible side, and said fluid flows through said aperture as said flexible side is depressed.

6. A fluid dispensing bottle comprising:

a reservoir extending within said bottle for holding a fluid, wherein said reservoir includes a reservoir opening:

a first hook for hanging said bottle in an inverted orientation;

a metering portion, extending from said reservoir, wherein said fluid is dispensed through an external opening within said metering portion, and wherein said metering portion controls a rate at which said fluid is dispensed;

a floating member moving within said metering portion with a level of water extending around said bottle in said inverted orientation to dispense a predetermined quantity of said fluid through said external opening in said metering portion; and a covering portion attached to close said external opening of said reservoir, wherein said covering portion is removable to outwardly expose said reservoir opening for refilling said reservoir, wherein said covering portion includes said metering portion.

7. The fluid dispensing bottle of claim 6, wherein said covering portion is attached to close said external opening of said reservoir by screw threads extending around said external opening of said reservoir.

8. The fluid dispensing bottle of claim 7, wherein said covering portion additionally includes a cap attached to close said external opening of said metering portion by screw threads extending around said external opening of said reservoir, said cap is removable to outwardly expose said external opening of said metering portion, and said cap is attachable to close said external opening of said reservoir by said screw threads extending around said external opening of said reservoir.

* * * * *